United States Patent [19]

Deubel

[11] 4,027,385

[45] June 7, 1977

[54] METHOD OF MANUFACTURING SEALED THERMOSTATS

[75] Inventor: Bernard S. Deubel, Mansfield, Ohio

[73] Assignee: Therm-O-Disc Incorporated, Mansfield, Ohio

[22] Filed: Jan. 26, 1976

[21] Appl. No.: 652,242

[52] U.S. Cl. ..... 29/622; 29/407; 29/593; 337/112

[51] Int. Cl.[2] ..... H01H 11/00

[58] Field of Search ..... 29/622, 445, 446, 448, 29/449, 450, 453, 407, 404, 405, 292; 337/380, 112, 343; 174/52 R, 52 PE; 200/293, 297, 302, 303, DIG. 28

[56] References Cited

UNITED STATES PATENTS

| | | | |
|---|---|---|---|
| 3,157,768 | 11/1964 | Ladd et al. | 337/380 |
| 3,302,269 | 2/1967 | Cooper et al. | 29/622 |
| 3,636,622 | 1/1972 | Schmitt | 29/622 |
| 3,893,057 | 7/1975 | Beunk et al. | 337/380 |
| 3,911,963 | 10/1975 | Denoor et al. | 29/405 X |

*Primary Examiner*—James R. Duzan
*Attorney, Agent, or Firm*—McNenny, Pearne, Gordon, Gail, Dickinson & Schiller

[57] ABSTRACT

A method of manufacturing sealed thermostats or the like is disclosed in which male and female members are assembled with an interference fit to produce a seal which is maintained through a predetermined operating temperature range. The minimum interference during assembly is selected so that such minimum interference is greater than the difference in the temperature during assembly and the most adverse seal temperature to be encountered within the temperature range, times the difference in coefficients of thermal expansion and contraction between the members times the linear dimension of the seal. In addition, the two members are selected so that the maximum total elastic deformation is greater than the difference in coefficient of thermal expansion and contraction times the difference between the maximum and minimum temperatures within the temperature range times the linear dimension. Preferably, the interference is selected so that the female member is stressed beyond its elastic limit, at least when the device is cycled throughout the temperature range to produce a mechanical interlocking of the two parts. The assembly of the device may also be arranged to provide calibration and/or gauging of the device.

14 Claims, 5 Drawing Figures

METHOD OF MANUFACTURING SEALED THERMOSTATS

BACKGROUND OF THE INVENTION

This invention relates generally to the manufacture of thermostats, and more particularly to a novel and improved method for manufacturing sealed thermostats.

PRIOR ART

In many instances, it is necessary to seal a thermal responsive device so that it can be installed and used in an environment which cannot be tolerated within the interior of the device. Also, in some instances, it is necessary to seal the leads so that shorts cannot occur between the leads or between a lead and the case of the device.

In the past, it has often been practiced to seal the thermostat with a potting material such as epoxy. One example of such potted thermostat is illustrated in the U.S. Patent to Schmitt, No. 3,451,028 issued June 17, 1969. Such letters patent, which are assigned to the assignee of the present invention, also describe a method of assembling a thermostat in which a switch header is pressed with an interference fit into a disc cup. After the header is pressed to the desired position, potting epoxy is placed within the cup over the header to seal the thermostat and leads and to lock the header in its assembled position.

In some instances, the header is pressed to a gauge position, which is varied from device to device to compensate for variations in the dimensional tolerances of the parts of the device. Such assembly procedure, sometimes referred to as push-to-gauge, provides a simple method of gauging a device and provides automatic compensation for variations in the dimensional tolerances of the parts of the particular device being assembled.

In other instances, the disc is maintained at a predetermined operating temperature during assembly and a switch header is pressed into the cup until the disc operates. Such assembly method, sometimes referred to as press-to-calibrate, provides a simple method of calibrating a device as well as compensating for variations in the dimensional tolerances of the parts of the device.

The interference fit used in both press-to-gauge and press-to-calibrate has not, however, been intended to produce a seal. Instead, the practice has been to pot such devices for sealing the device and for locking the header in position.

In some environmental conditions, the seal produced by the potting material, such as epoxy, has been satisfactory. However, in some instances, the repeated cycling of the device through wide temperature ranges has caused the epoxy bond to break and the seal of the device has failed.

This has been particularly troublesome in devices such as defrost control devices for refrigerators which are exposed to relatively low temperatures in a moist environment. Generally potting materials such as epoxy have a coefficient of thermal expansion and contraction, which is greather than a coefficient of thermal expansion and contraction of the metal of the disc cup. Consequently, the bond between the metal disc cup and the potting material is highly stressed when the temperature of the device changes substantially from the temperature of the assembly and cure of the potting material. This stressing tends to cause slight fractures in the bond, particularly when the bond is placed in tension. In a moist environment, water enters such fractures and when it freezes and expands, the fracture is enlarged and failure of the bond often progresses until seal failure occurs.

In the past, the failure of the seal provided by the potting material often results in the total failure of the device, even when the device is assembled with an interference fit because the range of tolerances of the interference fit has not been selected to be great enough to insure an interference seal between the switch header and the disc cup under all temperatures encountered by the device.

SUMMARY OF THE INVENTION

There are a number of aspects to this invention. In accordance with one important aspect of this invention, a method of assembly of a thermal responsive device is arranged so that sufficient interference is provided during assembly to insure that an interference fit seal is maintained even when the device must function over wide temperature ranges. The tolerances range of interference fit is selected so that the seal obtained by the interference is maintained at the most adverse temperature to be encountered. Further, the materials which are stressed by the interference fit are selected to have sufficient elastic deformation to maintain the interference fit at all temperatures to be encountered. With such method, a permanent seal is obtained, even under repeated thermal cycling.

In accordance with another important aspect of this invention, a method of assembling thermally responsive devices is provided in which an interference fit produces a permanent seal, and in addition, locks the elements of the device in a position which is selected to provide calibration and/or gauging of the parts.

In accordance with still another aspect of this invention, a switch header formed of phenolic resin is pressed into a disc cup formed of stainless steel with an interference fit selected so that the cup is stressed beyond its elastic limit. With such a method of assembly, the minimum required interference is always insured when the two materials are selected to provide the required elasticity. Further, such method insures that all devices will have substantially the same seal characteristics throughout the entire selected range of interference fits.

These and other aspects of the present invention are described in detail in the following specification.

DETAILED DESCRIPTION OF THE DRAWINGS

Figure 1:
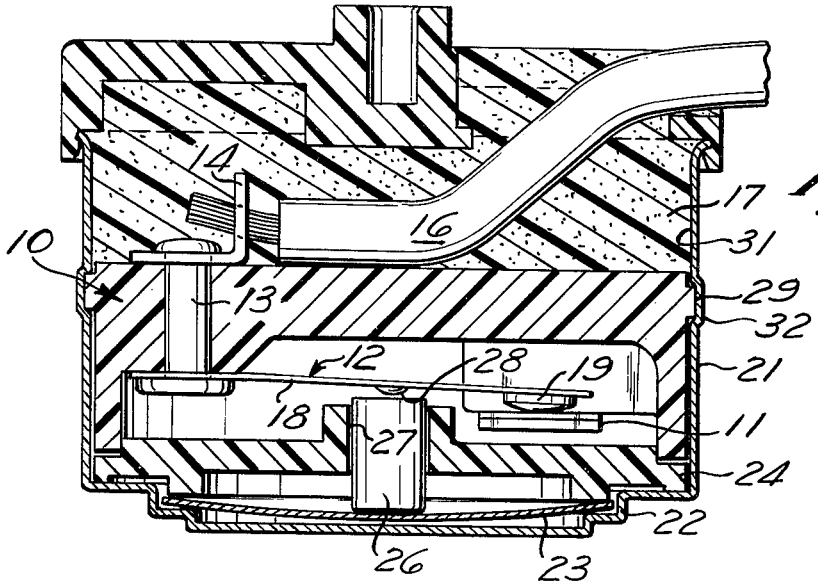
FIG. 1 is a side elevation and longitudinal section of a bimetallic snap disc thermostat assembled in accordance with the method of the present invention.

FIG. 1 shows one embodiment of the present invention in which an interference seal is obtained between the switch header and the disc cup. In such device, however, a potting epoxy is also employed to produce a seal with respect to terminals, and to prevent shorting between the terminals and between each terminal and the disc cup. The basic structure of this device has been manufactured by the assignee of the present invention for a considerable period of time. In the past, the device was assembled in accordance with a method in which the interference fit was not intended to produce a seal between the switch header and the disc cup as a result of the interference between these two parts. This device was manufactured substantially in accordance with the method of the U.S. Pat. No. 3,451,028, referred to above, and the epoxy potting compounds was utilized to both seal the device and lock the switch header in its assembled position.

The thermostat of FIG. 1 includes a switch header 10 formed of a phenolic resin on which a fixed contact 11 and a movable contact arm 12 are mounted by rivets 13. The rivet for mounting the fixed contact 11 does not appear in the plane of the section, since it is offset behind the plane of the section but is of a type similar to the rivet 13 for the movable contact 12. The movable contact 12 is connected through the rivet 13 and a terminal member 14 to a lead wire 16, having its inner end embedded in a potting material 17 such as epoxy. A similar lead is also connected to the rivet for the fixed contact 11, but again, does not appear in the drawings because it is behind the plane of the section.

The movable contact 12 consists of a spring arm 18, cantilever mounted at one end by the rivet 13, and provided with a contact element 19 at its free end. The switch header 10 is pressed with an interference fit into a metallic disc cup 21, preferably formed of stainless steel of the like. The manner of assembly is discussed in greater detail below. Positioned in a step 22 in the disc cup is a bimetal snap disc 23. Immediately above the disc 23 is a shield 24, which is preferably molded from a phenolic resin or the like. An elongated bumper 26 extends through and is guided within an opening 27, formed in the disc shield 24. When the disc 23 moves with snap action from the illustrated position to its upwardly curved position, the engagement between the bumper 26 and the central portion of the disc causes the bumber to move toward the movable contact 12 into engagement with a dimple 28, formed thereon and thereafter causes the contact element 19 to move out of engagement with the fixed contact 11 to open the switch. This switch opening action occurs very rapidly due to the snap action of the disc. When the disc snaps back to the illustrated position, the bumber allows the movable contact to move back into engagement with a fixed contact and closes the switch.

In order to provide a permanent seal between the switch header and the disc cup, the header 10 is formed with an annular rib 29, selected to have a diameter greater than the diameter of the inner wall 31 of the disc cup so that an interference fit is provided between the rib 29 and the disc cup 21. Consequently, when the switch header 10 is pressed into the disc cup 21, the disc cup is deformed from its unstressed condition to produce a mating rib or projection 32 in the side wall of the disc cup. This projection and the interference is exaggerated for purposes of illustration. However, in practice, when the header is formed of a phenolic resin having a rib diameter of about 1 inch, and in which the phenolic resin forming the disc header has a coefficient of thermal expansion and contraction of about $2 \times 10^{-5}$ inches per degree Fahrenheit, is assembled in a disc cup formed of stainless steel having a coefficient of thermal expansion and contraction of $9.6 \times 10^{116\ 6}$ inches per degree Fahrenheit and a wall thickness in the order of 0.012 inches. The interference fit is selected to be within a range of 0.007 to 0.015 inches of interference. When such interference is provided with these materials, the material of the header provides sufficient strength to deform the wall of the disc cup as the switch header is pressed into the disc cup to its final position. Such a thermostat is intended to be capable of repeated thermal cycling between a temperature from about −100° F. to about 200° F., or through a range of temperatures in the order of 300° F. without loss of the seal provided by the interferences fit.

In such a device, the most adverse condition for the seal produced by the interference fit occurs at low temperatures, since the coefficient of thermal expansion of the material forming the switch header is greater than the coefficient of thermal expansion and contraction of the material forming the disc cup. Since the coefficient of thermal expansion and contraction of the material forming the switch header is greater than the coefficient of thermal expansion and contraction of the material forming the disc cup, the header contracts more than the disc cup as the temperature drops. Consequently, when the temperature reaches the minimum temperature to be encountered, such as for example, −100° F., a minimum interference condition is reached. The initial interference, which is selected at the assembly temperature, usually on the order of 70° F., therefore must be sufficient to maintain the interference seal under the lowest temperature to be encountered in such a device. In accordance with the method of the present invention, the minimum initial interference is selected in accordance with the following formula: $Ia > [Ta - Tmi]\ [Ks - Kc]\ D$ where:

Ia = the minimum assembly interference
Ta = the temperature of assembly
Tmi = the minimum temperature to be encountered
Ks = the coefficient of thermal expansion and contraction of the material forming the switch header
Kc = the coefficient of thermal expansion of the material forming the disc cup
D = the diameter of the rib 29

When the initial interference is sufficiently great to meet the requirements of this formula, the interference will be maintained, even at the minimum temperature to be encountered, which is most adverse temperature condition when considering the seal produced by the interference.

In order to provide a permanent seal, it is also necessary to select the materials forming the switch header and the disc cup, so that sufficient elasticity or elastic deformation is provided to maintain the seal under the most adverse conditions. In order to meet this requirement, the following formula should be complied with:

$$Emax > [Tmax - Tmi]\ [Ks - Kc]\ D$$

In this instance, the additional terms mean the following:

Emax = the maximum total elastic deformation
Tmax = the highest temperature expected to be encountered The remaining terms are the same as in the preceeding formula. It should be recognized that the total elastic deformation consists of elastic deformation of both the cup and the switch header, even though the dimensional value of the elastic deformation of the header in compression is usually substantially less than the dimensional value of the elastic deformation of the disc cup and tension.

The potting material 17, illustrated in FIG. 1, in most instances, will provide an additional seal between the inner wall 31 and of the disc cup and the rib 29. However, the seal provided by this material can and usually does deteriorate when the device is thermally cycled at low temperatures. This is because the potting material generally has a greater coefficient of thermal expansion and contraction than the metallic disc cup and the bond between the potting material and the disc cup is, therefore, placed in tension at low temperatures. Therefore, there is a tendency for fractures to occur along the interface between the potting material and the inner surface of the disc cup, which progress as the device is repeatedly cycled to low temperatures until the seal provided by the potting material fails and only the seal produced by the interference fit between the switch header and the disc cup 21 remains.

In practice, however, the potting material does provide a lasting seal between the leads 16 and the switch header 10, so that leakage cannot occur in along the leads and along the rivets 13 to the interior of the switch. It is for this reason that the potting material 17 is provided in the thermostat of FIG. 1. This seal, with the leads and with the terminal elements is not severly stressed and tends to be in shear rather than in tension in such structure, so the seal, provided by the potting material with the terminals and the leads does not fail and the integrity of this total seal is maintained. In the device of FIG. 1, a mounting cover is provided at the open end of the disc cup to provide a structure for mounting the thermostat.

Although it is possible to practice the method in accordance with the present invention, in accordance with its broader aspects by selecting a range of interferences so that the material of the disc cup is not stressed beyond its elastic limits, it is preferable to select an interference fit which is sufficiently great to insure that the material of the projecting rib 32 in the wall of the disc cup is stressed beyond the elastic limit of the material forming the disc cup. When the interference range is selected to insure such deformation beyond the elastic limit, it is not necessary to provide very close tolerances in the interference fit and uniformity of the seal is produced because the elastic deformation in the assembled device is determined by the elastic limit of the cup material rather than by the interference between the particular parts being assembled.

Both of the formulas above, however, still have to be met, but the maximum total elastic deformation is determined essentially by the properties of the material forming the disc cup, because the material of such cup is stressed beyond its elastic limits. It must be recognized that even though the material is stressed beyond its elastic limit, elastic deformation remains and that as the stress is relieved by dropping temperatures, the disc cup rib 32 elastically contracts to maintain the seal.

When the cups and header are sized so that the cup is not deformed beyond its elastic limit, the two parts are retained in position primarily by friction. Such friction locking is often satisfactory. However, when a positive mechanical interlock is desired, the device is manufactured so that the material of the rib 32 and the cup 21 is deformed beyond its elastic limit when the temperature of the device is first elevated to its maximum temperature within the operating temperature range. Such deformation produces a permanent rib in the cup side wall having a diameter greater than the one on both sides of the rib to mechanically interlock the two parts.

Such deformation beyond the elastic limit of the cup can occur even when the interference during assembly does not produce deformation beyond the elastic limit of the cup. For example, in the illustrated embodiment of FIG. 1, the metal cup has a lower coefficient of thermal expansion and contraction than the header 10. Therefore, the interference between the two parts at room temperature during assembly is not the maximum interference. Instead, the greatest interference occurs when the temperature of the device is elevated after assembly to the maximum temperature. When the parts are selected so that the cup is deformed beyond its elastic limit during such increase in temperature, a step is produced in the cup at 32 which insures a mechanical interlocking of the two parts.

As mentioned above, the dimensional tolerances that must be maintained on the interference fit need not be as closely maintained when such fit is selected to insure deformation of the cup beyond its elastic limit during assembly. Also, when the fit is selected to produce stresses in the cup beyond its elastic limit during assembly, the increased stresses which occur when the temperature is increased, insures further non-elastic deformation and insures the establishment of a mechanical interlocking connection. When both advantages are desired, it is therefore, preferable to select the interference fit to produce stresses which deform the part beyond its elastic limit during assembly.

Figure 2:
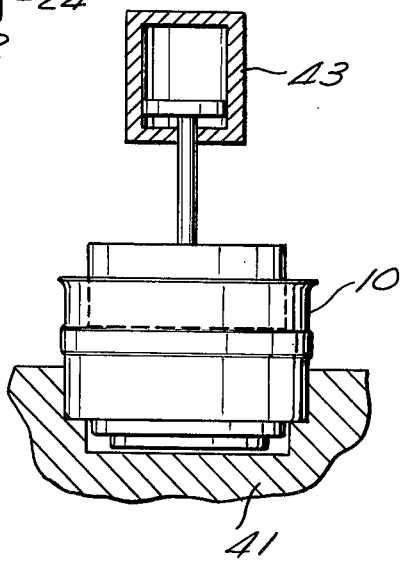
FIG. 2 is a schematic view of a power actuator operating to assemble the thermostat of FIG. 1, in accordance with the method of this invention.
Figure 3:
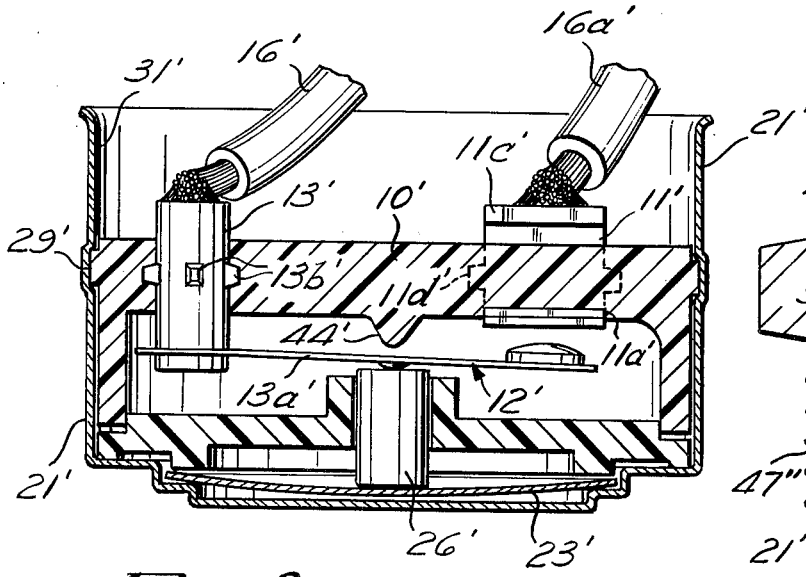
FIG. 3 is a side elevation in longitudinal section of another embodiment of a bimetallic snap disc thermostat assembled in accordance with the present invention.

In accordance with the method of the present invention, the switch elements are riveted to the switch header 10 and the leads 16 are connected as a subassembly. The disc 23 is then positioned in the disc cup along with the bumper 26 and the disc shield 24. The disc cup is then supported, for example, by a support element 41 of the type illustrated in FIG. 2, and the switch header is pressed by any suitable actuating means such as an actuator 43 into the switch cup to the assembled position required. When the device is assembled by press-to-gauge, the disc is assembled in its upwardly curved position and the switch header is pressed in while sensing switch operation, as described in the U.S. Pat. No. 3,451,028. In instances where the assembly is intended also to provide calibration of the device, the disc is again assembled in its upwardly curved position and is maintained at the desired operating temperature of the device. The switch header is then pressed into the disc cup until a position is reached in which a sufficient force is applied to the disc to cause the disc to snap through to its lower curved position. The operation of the switch is sensed to terminate further inward movement of the switch header. Usually in pressing-to-calibrate, a switch structure is provided wherein a stop such as the projection 44′ illustrated in FIG. 3 is provided on the switch header to engage the side of the movable contact opposite the bumper to bring the disc in until it operates at the then existing temperature of the disc. However, in some instances, the disc can be calibrated during assembly by moving the switch case in until the force applied to the disc through the bumper by the spring arm of the switch or some other spring is sufficiently great to cause the disc to snap through.

In accordance with the illustrated embodiments of the present invention, therefore, the seal obtained by the interference is accomplished during the same assembly as the gauging or the calibration as the case may be. Once the switch header is in the desired position, sufficient interference is produced to lock the switch header in the installed position.

Figure 4:
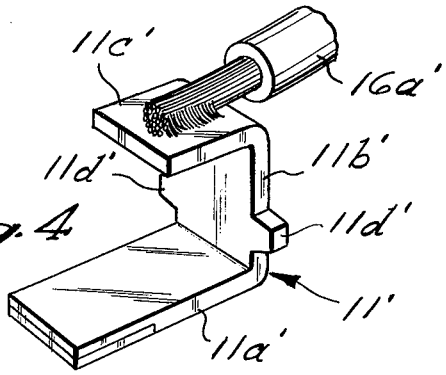
FIG. 4 is an enlarged fragmentary perspective view of the fixed contact of the device illustrated in FIG. 3; and, FIG. 5 is a fragmentary view partially in longitudinal section of a thermostat incorporating the present invention wherein a seal is produced with an interference fit in which inward elastic deformation is produced by the interference established during assembly of the device.

FIGS. 3 and 4 illustrate an embodiment of the present invention in which complete sealing is obtained without requiring a potting material. In this embodiment similar reference numerals are used to refer to similar parts, but a single prime is added to indicate reference to the embodiment of FIGS. 3 and 4. Here again, a switch header 10' is formed of phenolic resin or the like and supports a switch consisting of a fixed contact 11' and a movable contact 12'. The fixed contact 11' is illustrated in FIG. 4 and is generally U-shaped. One leg 11*a'*extends along the inner surface of the header 10', the base of the U 11*b'*extends up through the header material, and a lead 16*a'*is welded to the exterior leg 11*c'*. Projections 11*d'*are embedded in the header to assist in locking the fixed contact in position. The fixed contact 11' is molded into the header 10' in such a way that the resin material of the header 10' bonds and seals to the fixed contact to prevent leakage along the fixed contact between the interior and exterior of the device.

The movable contact arm 13*a'*is supported on a rivet element 13' which is also molded into the header so as to produce a bonding seal at the interface between the rivet 13' and the header material. Here again, the projections 13*b'*are embedded in the header material to assist in locking the rivet in place. The lead 16' is welded to the exterior end of the rivet 13'. In this embodiment, the movable contact is biased away from the fixed contact.

With this structure in which a seal is provided between the terminal or contact elements and the header, it is not necessary to utilize a potting material to produce a seal between the header and the switch elements, per se. Consequently, the embodiment of FIGS. 3 and 4 is not provided with potting material.

In the embodiments of FIGS. 3 and 4, provision is made for push to calibrate. In such embodiment, the header 10' is formed with a projection 44' on the side of the movable arm 12' opposite the bumper 26'. During the assembly of this embodiment, the disc 23' is placed in the disc cup 21' in its upwardly curved position and assembly takes place in an environment which maintains the disc 23' at the desired operating temperature for opening the switch. As the header 10' is pressed into the cup, the action of the disc engaging the bumper causes the switch to be closed, and this condition is sensed. As the header continues to move into the disc cup 21', the projection 44' engages the side of the movable arm 13*a'*opposite the bumber 26' and applies a force through the movable arm 13*a'*and bumper 26' to the disc 23'. This mechanically presses the disc 23' toward its downward curved position illustrated, and ultimately causes the disc to snap through to the illustrated position. This allows the switch to open and such action is sensed to terminate further inward movement of the header. Such method of assembly provides automatic gauging to compensate for variations in the dimensions of the particular parts of the assembly and also, automatically calibrates the disc to operate at the desired temperature during assembly. Here again, the interference provided by the rib or projection 29' is selected with respect to the diameter of the inner wall 31' of the cup so as to produce a permanent seal between the cup and the switch header. Consequently, full sealing is obtained in this embodiment without requiring epoxy and by the simple expedience of assembling the device with the required interference to produce the seal.

Figure 5:
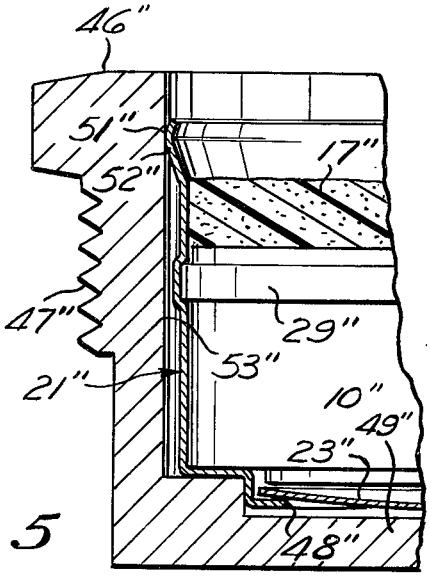

FIG. 5 illustrates still another embodiment of this invention. In this embodiment, similar reference numerals are again provided, but a double prime is added to refer to the embodiment of FIG. 5. The disc cup 21'' and the switch header 10'' are assembled in the same manner as in the embodiment of FIG. 1 and a potting material 17'' is provided above the header to seal with the leads in the terminal elements. However, the entire device is assembled in a cup-shaped stud 46'' which is threaded at 47'' so that it can be mounted in an engine block or the like. The cup 21'' is formed with an aperture 48'' so that the disc 23'' is opened to the end wall 49'' for greater sensitivity. Consequently, it is necessary to provide a secondary seal between the cup 21'' and the stud 46''. This seal is provided at 51'' by an interference fit between a flaired section 52'' of the cup 21'' adjacent to its open end and the inner wall 53'' of the stud 46''. In this embodiment, the thermostat itself is assembled by first pressing the switch header 10'' so that a seal is provided between the rib 29'' and the cup 21''. The thermostat is then press fitted into the stud 46'' to produce the seal 51'' between the cup 21'' and the stud 46''. The potting material 17'' can be applied either before or after the device is assembled within the stud 46''.

In the embodiment of FIG. 5, the interference fit seal at 51'' between two metal parts in which the inner part is radially deformable and the outer part or the stud 46'' is provided with a sufficiently heavy wall so that it is not deformed during assembly to any significant extent.

With the present invention, a permanent seal which is capable of withstanding wide variations in temperature, is easily and reliably provided. In addition, when either gauging or calibration or both is required, the same assembly method that produces the seal is arranged to provide the gauging or calibration as the case may be. It should be understood, however, in accordance with the broader aspects of this invention, the method may be utilized to provide a seal even when gauging or calibration is not involved.

Although preferred embodiments of this invention are illustrated, it should be understood that various modifications and rearrangements of parts may be resorted to without departing from the scope of the invention disclosed and claimed herein.

What is claimed is:

1. A method of manufacturing sealed thermal responsive devices in which said seal is maintained over a predetermined temperature range and the seal is established between a male member and a female member comprising sizing said members to provide a minimum interference fit, and assembling said male member within said female member to produce an interference fit seal, and interference during assembly being selected so that it is greater than the difference in coefficients of thermal expansion and contraction of said members times the difference in temperature between the temperature of assembly and the most adverse seal temperature within said predetermined temperature range times the linear dimension of said seal, said members also being selected so that the maximum elastic deformation within said predetermined temperature range is greater than said difference in coefficients in thermal expansion and contraction times the difference between the maximum and the minimum temperatures of said predetermined temperature range times said linear dimension.

2. A method of manufacture as set forth in claim 1 wherein said coefficient of thermal expansion and contraction of said male member is greater than the said coefficient of thermal expansion and contraction of said female member.

3. A method of manufacture as set forth in claim 1 wherein said device includes a switch operated by a bimetal snap disc, and said male member is pressed into said female member while sensing switch operation to determine an assembled gauged position which compensates for dimensional tolerances of the parts of said device.

4. A method of manufacture as set forth in claim 1 wherein said device includes a switch operated by a bimetal snap disc which is calibrated during assembly, said male member being pressed into said female member while said disc is maintained at its desired operating temperature causing said disc to be pulled in until it operates, said disc operation being sensed to terminate further movement between said members.

5. A method of manufacture as set forth in claim 1 wherein said device includes switch terminals extending through said male member, and a seal is provided between said male member and terminals.

6. A method of manufacture as set forth in claim 5 wherein said seal between said male member and terminals is provided by applying a potting material around said terminals.

7. A method of manufacture as set forth in claim 1 wherein one of said members is deformed beyond its elastic limit by said interference fit.

8. A method of manufacture as set forth in claim 7 wherein said one member is said female member.

9. A method of manufacture as set forth in claim 8 wherein said female member is a metal cup shaped member and said male member is a phenolic resin or the like, said male member being provided with a rib of maximum diameter which cooperates with the inside diameter of said cup to determine said interference fit.

10. A method of manufacture as set forth in claim 9 wherein said members are press fitted together at a temperature substantially different than the temperature producing said maximum elastic deformation and the temperature of the device is elevated after assembly to produce additional deformation beyond the elastic limit of said cup shaped member.

11. A method of manufacture as set forth in claim 1 wherein said female member is formed of metal and is stressed in tension, said female member being deformed beyond its elastic limit during the first increase in temperature of said device to the maximum temperature within said temperature range to form an interlocking engagement between said members.

12. A method of manufacture as set forth in claim 11 wherein said interference fit is selected to insure deformation of said female member beyond its elastic limit during the assembly of said members.

13. A method of manufacture as set forth in claim 1 wherein a switch is assembled on said male member and a bimetal snap disc is positioned in said female member before said male and female members are press fitted together.

14. A method of manufacture as set forth in claim 1 wherein said members are both formed of metal, and said male member is formed with a resilient section which is deformed radially inward during assembly an amount greater than the deformation of said female member.

* * * * *